US007009341B2

(12) United States Patent
Wu et al.

(10) Patent No.: US 7,009,341 B2
(45) Date of Patent: Mar. 7, 2006

(54) COLOR PLASMA DISPLAY PANEL

(75) Inventors: Jiun-Han Wu, Hsinchu (TW); Po-Cheng Chen, Hsinchu (TW); Shou-Ling Sui, Hsinchu (TW)

(73) Assignee: AU Optronics Corporation, (TW)

( * ) Notice: Subject to any disclaimer, the term of this patent is extended or adjusted under 35 U.S.C. 154(b) by 127 days.

(21) Appl. No.: 10/693,537

(22) Filed: Oct. 23, 2003

(65) Prior Publication Data

US 2005/0088090 A1 Apr. 28, 2005

(51) Int. Cl.
*H01J 17/49* (2006.01)

(52) U.S. Cl. ..... 313/582

(58) Field of Classification Search ..... 313/581–587; 315/169.4; 345/37, 41, 60
See application file for complete search history.

(56) References Cited

U.S. PATENT DOCUMENTS

| | | | | |
|---|---|---|---|---|
| 6,242,860 | B1 * | 6/2001 | Sasao et al. | 313/586 |
| 6,373,195 | B1 | 4/2002 | Whang et al. | |
| 6,420,835 | B1 | 7/2002 | Chen et al. | |
| 6,577,061 | B1 * | 6/2003 | Sano et al. | 313/582 |
| 6,838,825 | B1 * | 1/2005 | Shiiki et al. | 313/582 |
| 2004/0124775 | A1 * | 7/2004 | Okada et al. | 313/587 |

FOREIGN PATENT DOCUMENTS

JP 10-326571 8/1998

* cited by examiner

*Primary Examiner*—Ashok Patel
(74) *Attorney, Agent, or Firm*—Duane Morris LLP

(57) ABSTRACT

A plasma display panel having an array of display cells, each display cell having a closed-rib structure and provided with a fluorescent layer wherein the fluorescent layer thickness in at least one of the display cells is different from the fluorescent layer thickness in other display cells.

11 Claims, 2 Drawing Sheets

COLOR PLASMA DISPLAY PANEL

FIELD OF THE INVENTION

The present invention provides a color plasma display panel, and more particularly to a color plasma display panel that can adjust the covering area of fluorescence layer to increase the color temperature.

BACKGROUND OF THE INVENTION

Color plasma display panels (PDP) are provided with several hundred thousand display cells in permutations and combinations that are several hundred micrometers in size. Each of the display cells is a sub-pixel that is one of three color types: red, green or blue. Three of these sub-pixel display cells, one of each color type, form a color pixel of the PDP. The display cells are illuminated by applying a voltage, also called the driving voltage, on a discharging gas in order to produce a plasma that discharges ultraviolet light. Each display cell has a fluorescent layer that fluoresces when exposed to the ultraviolet light discharged by the plasma. The fluorescent layers in the display cells are made of one of three phosphor materials, one for each color type.

Generally, the phosphor material of the fluorescent layer determines the color emitted from the fluorescent layer. For example, when the fluorescent material contains (Y, Gd, Eu)$BO_3$, a red fluorescent ray is produced; when the fluorescent material contains $(Zn, Mn)_2 SiO_4$, a green fluorescent ray is produced; and when the fluorescent material contains (Ba, Eu)$MgAl_{10}O_{17}$, a blue fluorescent ray is produced.

In conventional PDPs having closed rib structure display cells, the fluorescent layers in every display cell are of the same thickness. But, because the fluorescence layers for each of the three color types are different phosphor materials, they each have different lighting voltage ranges and as a results require a different driving voltage. This is not preferable for optimal operation of a PDP. Thus, improved display units for PDP are desired where the driving voltage ranges for each of the red, green, and blue display cells are uniform.

SUMMARY OF THE INVENTION

According to an aspect of the present invention, disclosed herein is a plasma display panel (PDP) having an array of display cells. Each of the display cells has a closed-rib structure with barrier ribs, a rear plate of the PDP, and a front plate of the PDP defining a closed plasma discharge space. The rear plate forms the bottom of the display cells and the barrier ribs form the sidewalls of the display cells. A fluorescent layer is provided on the sidewalls and the bottom wall of the display cell. The thickness of the fluorescent layer relative to the bottom wall (hereinafter called "fluorescent layer thickness") in at least one of the display cells is different from the fluorescent layer thickness in other display cells. The lighting voltage range of a display cell depends on the particular phosphor material forming the fluorescent layer and the fluorescent layer thickness. By varying the fluorescent layer thickness of the display cells, the voltage range of each cell can be controlled and compensate for the different phosphor material required for each of the red, green and blue color display cells.

For example, the thicknesses of the fluorescent layers in the display cells in each of the color groups, red, green, and blue may be set to desired thicknesses so that the lighting voltage range required for the three color groups are the same. Another benefit of adjusting the fluorescent layer thicknesses in the display cells is that one can adjust the surface area of the fluorescent layer by changing the fluorescent layer thickness and, in turn, adjust the amount of light emitted by each of the three color groups in the color pixels. By adjusting the ratio of the red, green, and blue light in the color pixels, the white balance state can be reached and the color temperature of the color PDP can be optimized.

DETAILED DESCRIPTION

Figure 1:
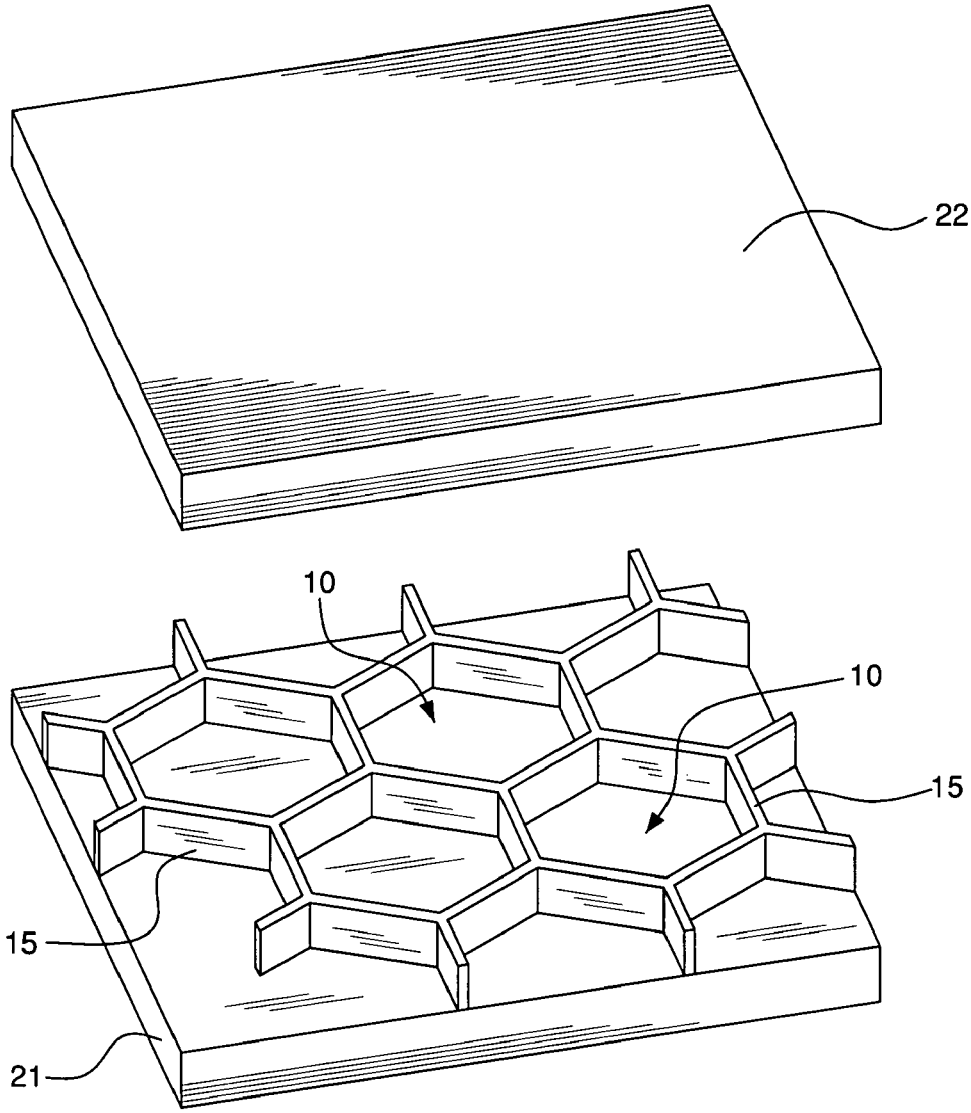
FIG. 1 is an exploded perspective view of a portion of an exemplary plasma display panel having display cells that are hexagonally shaped and have a closed-rib structure.

FIG. 1 is an exploded perspective view of a portion of a conventional PDP having display cells 10 that are hexagonally shaped and have a closed-rib structure. A PDP comprises a rear plate 21 on which the hexagonally shaped closed-rib display cells 10 are formed by barrier ribs 15. A transparent front plate 22 is provided on top of the display cells 10 and form closed plasma discharge spaces within each closed-rib display cell structures. The rear plate 21 and the front plate 22 generally accommodate the addressing electrodes (not shown) and the driving electrodes (not shown) of the PDP for illuminating the display cells.

Figure 2:
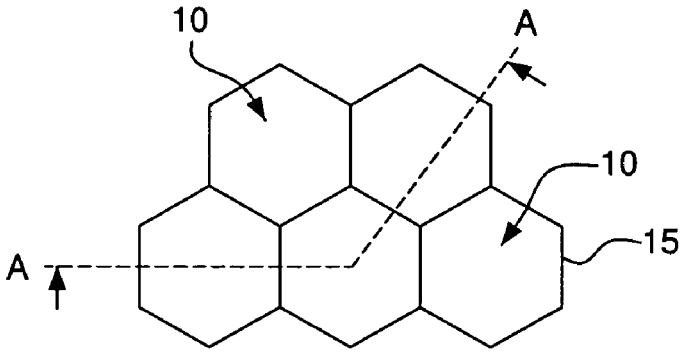
FIG. 2 is a plan view of an array of hexagonally shaped closed-ribbed display cells.

FIG. 2 is a schematic plan view diagram of a portion of a PDP showing an array of display cells 10 in a conventional PDP where the display cells have a hexagonal closed-rib structure. Barrier ribs 15 form the hexagonal closed-rib structure of the display cells 10.

Figure 3:
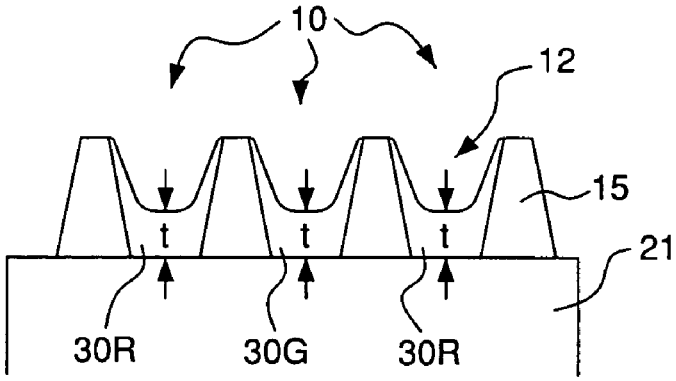
FIG. 3 ( PRIOR ART )
FIG. 3 is a sectional view of the display cells of FIG. 2 taken along the plane A—A illustrating the fluorescent layers provided within each display cells according to the structures found in the conventional plasma display panels.

FIG. 3 is a sectional view of the array of display cells 10 in FIG. 2 taken along the plane A—A. Each display cell has a closed plasma discharge space 12 defined by the barrier ribs 15, the rear plate 21, and the front plate 22 (not shown). And within each of the closed plasma discharge spaces 12 is provided a fluorescence layer 30. In the illustrated example, 30R is a red fluorescent layer, 30G is a green fluorescent layer, and 30B is a blue fluorescent layer. In this conventional PDP, the three fluorescent layers 30R, 30G, and 30B have the same thickness t. But, because the phosphor material forming the fluorescent layers 30R, 30G, and 30B are different, they have different lighting voltage ranges. Since it is not practical to deliver different driving voltages to each of the red, green, and blue display cell groups, the varying lighting voltage ranges result in non-optimal performance of the conventional PDP.

Figure 4:
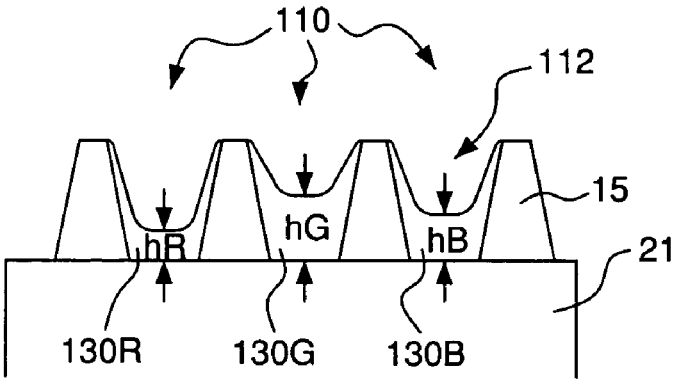
FIG. 4 is a sectional view of the display cells of FIG. 2 taken along the plane A—A illustrating the fluorescent layers provided within each display cells according to an embodiment of the present invention.

FIG. 4 illustrates closed-rib display cells 110 of a PDP according to an embodiment of the present invention. The structure illustrated in FIG. 4 is also a sectional view of an array of display cells similar to the sectional view of a prior art structure shown in FIG. 3. The closed-rib structures are formed by the barrier ribs 15. Within each of the display cells 110, a closed plasma discharge space 112 is formed by the rear plate 21, the barrier ribs 15, and the front plate 22 (shown in FIG. 1). The rear plate 21 (specifically, a dielectric layer formed on the rear plate) forms the bottom of the display cells 110 and the barrier ribs 15 form the sidewalls of the display cell 110. Within each of the display cells 110 is provided a fluorescent layer 130 covering the sidewalls and the bottom. In a red display cell is a red fluorescent layer 130R, in a green display cell is a green fluorescent layer 130G, and in a blue display cell is a blue fluorescent layer 130B. And as illustrated in FIG. 4, according to an aspect of the present invention, the thicknesses hR, hG, and hB of the fluorescent layers 130R, 130G, and 130B, respectively may be all different. According to another embodiment of the present invention, at least one of the fluorescent layers 130R, 130G, and 130B may have a different thickness.

The fluorescent layers are generally formed by screen-printing phosphor pastes into display cells. After the phosphor pastes are screen-printed, the panel is dried to remove the pastes' solvent component. During the drying process, phosphor powders adhere to the display cells' sidewalls and the bottom. The dried phosphor powder's thickness on the bottom of the display cell (i.e., the fluorescent layer thickness) is dependant upon the solid content of the phosphor paste. Thus, a desired fluorescent layer thickness can be achieved by adjusting the solid content of the phosphor paste. For example, the fluorescent layer thickness can be increased or decreased by increasing or decreasing the solid content of the phosphor paste, respectively.

By varying the thickness of the fluorescent layers, the lighting voltage ranges for the display cells can be adjusted. Thus, according to an aspect of the present invention, the thickness of the fluorescent layers for the different color display cell groups may be adjusted so that the display cells of the three color groups in a PDP all have same lighting voltage range.

Furthermore, as illustrated in the sectional view of FIG. 4, and further discussed in U.S. Pat. No. 6,420,835 to Chen et al., the disclosure of which is incorporated herein by reference in its entirety, the surface areas of the fluorescent layers 130R, 130G, and 130B changes with changes in the thickness hR, hG, and hB of the fluorescent layers. Because the fluorescent layers 130 also cover the sidewalls (defined by the barrier ribs 15) of the display cells 110, when the thickness hR is reduced, for example, the surface area of the fluorescent layer 130R increases. Thus, by varying the thickness of the fluorescent layers according to an aspect of the present invention, the surface areas of the fluorescent layers for each of the three color display cell groups may be adjusted to control the color temperature of the pixels.

While the foregoing invention has been described with reference to the above embodiments, various modifications and changes can be made without departing from the spirit of the invention. For example, although the discussions herein have utilized hexagonally shaped closed-rib display cells only, present invention is applicable to closed-rib display cells having other shapes. Rectangular shaped closed-rib display cells, for example, are also commonly found in PDPs and the present invention is equally applicable to those PDPs. The particular shape of the closed-rib display cells is a matter of design choice and the present invention is applicable to all variety of shapes that may be practiced with closed-rib display cells in plasma display panels. Accordingly, all such modifications and changes are considered to be within the scope of the appended claims.

What is claimed is:

1. A plasma display panel having an array of display cells, each of the display cells comprising:

a closed plasma discharge space, the closed plasma discharge space peripherally enclosed by a closed-rib structure of the display cell; and a fluorescent layer provided in the closed plasma discharge space, the fluorescent layer having a fluorescent layer thickness; wherein the fluorescent layer thickness in at least one of the closed plasma discharge spaces is different from the fluorescent layer thickness in another one of the closed plasma discharge spaces.

2. The plasma display panel of claim 1, wherein the at least one of the closed plasma discharge spaces whose fluorescent layer thickness is different from the fluorescent layer thickness in another one of the closed plasma discharge spaces has a red fluorescent layer.

3. The plasma display panel of claim 1, wherein the at least one of the closed plasma discharge spaces whose fluorescent layer thickness is different from the fluorescent layer thickness in another one of the closed plasma discharge spaces has a green fluorescent layer.

4. The plasma display panel of claim 1, wherein the at least one of the closed plasma discharge spaces whose fluorescent layer thickness is different from the fluorescent layer thickness in another one of the closed plasma discharge spaces has a blue fluorescent layer.

5. A plasma display panel having an array of display cells, each of the display cells comprising:

a closed plasma discharge space, the closed plasma discharge space defined by a rear plate of the plasma display panel, a closed barrier rib structure peripherally enclosing the closed plasma discharge space, and a front plate of the plasma display panel;

a first fluorescent layer coated on the sidewalls and the bottom wall of a first display cell, the first fluorescent layer having a first fluorescent layer thickness;

a second fluorescent layer coated on the sidewalls and the bottom wall of a second display cell, the second fluorescent layer having a second fluorescent layer thickness;

a third fluorescent layer coated on the sidewalls and the bottom wall of a third display cell, the third fluorescent layer having a third fluorescent layer thickness;

wherein at least one of the three fluorescent layer thicknesses is different from the other two fluorescent layer thicknesses.

6. The plasma display panel of claim 5, wherein the at least one of the three fluorescent layer thicknesses that is different from the other two fluorescent layer thicknesses is thickness of a red fluorescent layer.

7. The plasma display panel of claim 5, wherein the at least one of the three fluorescent layer thicknesses that is different from the other two fluorescent layer thicknesses is thickness of a green fluorescent layer.

8. The plasma display panel of claim 5, wherein the at least one of the three fluorescent layer thicknesses that is different from the other two fluorescent layer thicknesses is thickness of a blue fluorescent layer.

9. The plasma display panel of claim 1, wherein the display cells further comprise a hexagonally shaped structure.

10. A plasma display panel comprising:

a front plate;

a rear plate;

a closed-rib structure disposed between the front and rear plates, the closed-rib structure defining an array of closed display cells between the front and rear plates, each of the closed display cells enclosed entirely along its periphery by one or more ribs of the closed rib structure and thereby defining a closed discharge space; and a fluorescent layer of a fluorescent layer thickness provided in each of the closed plasma discharge spaces, wherein the fluorescent layer thickness in at least one of the closed plasma discharge spaces is different from the fluorescent layer thickness in another one of the closed plasma discharge spaces.

11. The plasma display panel of claim 10, wherein the display cells further comprise a hexagonally shaped structure.

* * * * *